US008684737B1

(12) United States Patent
Jordan

(10) Patent No.: US 8,684,737 B1
(45) Date of Patent: Apr. 1, 2014

(54) HANDGUN TRIGGER TRAINING DEVICE AND METHOD

(76) Inventor: Derrick A Jordan, South Holland, IL (US)

( * ) Notice: Subject to any disclaimer, the term of this patent is extended or adjusted under 35 U.S.C. 154(b) by 158 days.

(21) Appl. No.: 13/078,316

(22) Filed: Apr. 1, 2011

(51) Int. Cl.
*F41A 33/00* (2006.01)

(52) U.S. Cl.
USPC ..... 434/16

(58) Field of Classification Search
None
See application file for complete search history.

(56) References Cited

U.S. PATENT DOCUMENTS

| | | | | | |
|---|---|---|---|---|---|
| 835,873 | A | | 11/1906 | Thompson | |
| 843,291 | A | | 2/1907 | Mullins | |
| 1,487,631 | A | | 11/1920 | Wenger | |
| 1,494,407 | A | * | 5/1924 | Beach | 42/106 |
| 1,602,709 | A | | 5/1926 | Sandow | |
| 1,796,216 | A | | 3/1931 | Pettersson | |
| 2,837,334 | A | | 6/1958 | Long | |
| 3,003,764 | A | | 10/1961 | Yovanovitch | |
| 3,447,415 | A | | 6/1969 | Kime | |
| 3,738,651 | A | | 6/1973 | Norman et al. | |
| 4,046,130 | A | | 9/1977 | Najarian | |
| 4,362,145 | A | | 12/1982 | Stelcher | |
| 4,678,181 | A | | 7/1987 | Ditsch et al. | |
| 4,789,339 | A | * | 12/1988 | Bagnall-Wild et al. | 434/20 |
| 5,016,382 | A | * | 5/1991 | Pickle | 42/148 |
| 5,035,622 | A | * | 7/1991 | Marshall et al. | 434/23 |
| 5,147,256 | A | | 9/1992 | Silagy | |
| D352,754 | S | | 11/1994 | Silagy | |
| 5,443,543 | A | * | 8/1995 | Epes et al. | 42/112 |
| 5,501,135 | A | * | 3/1996 | Beretta | 89/196 |
| 5,881,912 | A | * | 3/1999 | Bokros | 222/1 |
| 5,951,296 | A | | 9/1999 | Klein | |
| 6,205,696 | B1 | * | 3/2001 | Bilgeri | 42/75.02 |
| 6,295,751 | B1 | * | 10/2001 | Piwonski | 42/1.15 |
| 6,322,365 | B1 | * | 11/2001 | Shechter et al. | 434/21 |
| 6,470,615 | B1 | | 10/2002 | Peterken | |
| 6,572,375 | B2 | * | 6/2003 | Shechter et al. | 434/19 |
| 6,732,464 | B2 | | 5/2004 | Kurvinen | |
| 6,968,770 | B2 | * | 11/2005 | Barfield et al. | 89/29 |
| 6,994,011 | B2 | * | 2/2006 | Barfield et al. | 89/29 |
| 7,677,893 | B2 | * | 3/2010 | Lvovskiy | 434/21 |
| 7,927,266 | B1 | * | 4/2011 | Morris | 482/122 |
| 8,336,459 | B1 | * | 12/2012 | Gould | 102/336 |
| 8,359,777 | B2 | * | 1/2013 | Zajk | 42/59 |
| 8,371,058 | B2 | * | 2/2013 | Trpcic | 42/108 |
| D678,454 | S | * | 3/2013 | Emde et al. | D22/104 |
| 8,387,294 | B2 | * | 3/2013 | Bolden | 42/1.01 |
| 2011/0047847 | A1 | * | 3/2011 | Hughes et al. | 42/1.01 |
| 2012/0214136 | A1 | * | 8/2012 | Stone | 434/16 |
| 2012/0279105 | A1 | * | 11/2012 | Emde et al. | 42/1.08 |
| 2012/0313299 | A1 | * | 12/2012 | Bleicken et al. | 266/48 |
| 2013/0042513 | A1 | * | 2/2013 | Szwast | 40/673 |

* cited by examiner

*Primary Examiner* — Kurt Fernstrom
*Assistant Examiner* — Dolores Collins
(74) *Attorney, Agent, or Firm* — Burns & Levinson LLP; Jacob N. Erlich

(57) ABSTRACT

A firearm trigger trainer, for aiding a trainee in developing a smooth trigger control, has a handle, sized and weighted to represent the actual weight and feel of the real firearm, but without a gun barrel, thus providing a non-threatening, non-fear inducing appearance of the firearm trigger trainer. The trigger member is coupled to a single biasing spring for biasing the trigger member for simulating triggering forces used in firing a real firearm; and the method instructs the trainee to smoothly actuate the trigger member over and over to produce smooth, even pressure to the trigger, thus enhancing accuracy of shots using real firearms. Two or more removable biasing springs having different stiffness are provided for substituting one spring for another to correspond to a particular firearm.

16 Claims, 5 Drawing Sheets

HANDGUN TRIGGER TRAINING DEVICE AND METHOD

BACKGROUND OF THE INVENTION

The present invention relates generally to the field of firearms, and, more particularly to usage of trigger actuated firearms and handguns and training devices.

A patent design for a device to aid in developing finger strength is disclosed in U.S. Design Pat. Des. 352,754 However this device is for a design and not for utility purposes.

U.S. Pat. No. 1,494,407 issued to O. M. Beach discloses a small arms practice apparatus having the shape of a handgun and which employs three movable mechanically biased parts "to enable one to be skilled in the art of aiming and firing small arms such as revolvers and rifles." However, this patent has limitations as will be explained hereinafter.

SUMMARY OF A PREFERRED EMBODIMENT OF THE INVENTION

A firearms training device for aiding a trainee to develop smooth trigger control of a real firearm which includes a handle, sized and weighted to represent the actual weight and feel of a real firearm, without a gun barrel, a trigger assembly attached to the handle and having a trigger arranged to be actuated by a finger of a trainee, and a biasing device for biasing the trigger in a forward direction away from the handle, the biasing device having a stiffness similar to the stiffness of an actual firearm trigger, for simulating triggering forces used in firing a real firearm. The device is arranged to train a person to use the correct manner of firing a handgun by learning to use smooth control of the trigger by moving the trigger rearwardly with no sudden motion and in a direction that would be parallel to the gun barrel on a real gun (The present device having no gun barrel as discussed below.)

The subject invention provides an enhanced, safe training device and method for training shooters in the proper and proficient way of smoothly manipulating triggers of any hand operated weapon, especially a handgun.

Firearms instructors always emphasize the importance of smooth trigger control as one of the key foundations of marksmanship. Trigger control is of great importance in producing an accurate shot. When the shooter exerts pressure on the trigger, he/she must do so in a manner that does not alter the sight alignment, or position of the pistol. Consequently, the shooter must be able to exert smooth, even pressure to the trigger. It is frequently said to learners that they should "squeeze" the trigger, not "jerk" it. This is a requirement for accurate shooting.

Often new and inexperienced shooters have a bad habit of consistently "jerking" the trigger, causing them to miss their desired target. "Jerking", is the abrupt application of pressure on the trigger accompanied with muscular action of the hand and arm muscles. "Jerking" is usually accompanied by:

A. the sharp straining of all the muscles in the arm and shoulder;

B. the abrupt tightening of the hand on the grip; and

C. failure to press the trigger directly to the rear.

In an effort to combat this "Jerking" of the trigger, firearm instructors suggest students practice trigger control by performing an exercise called "Dry-Firing." Dry-Firing is repeatedly pulling the trigger on a real but unloaded weapon. Unfortunately due to several accidental discharges, training incidents and safety reasons, most law enforcement agencies have established policy that forbids Dry-Firing outside of a firing range. These established policies limit the shooters ability to practice and develop the required dexterity and muscle memory that is essential to proficient marksmanship.

There is currently, to the knowledge of the inventor, no handgun training device in use that specifically isolates (movement of the trigger finger without moving anything else) and exercises the index (trigger) finger. The training device "Small Arms Practice Apparatus" U.S. Pat. No. 1,494,407 issued to Beach was designed to aid in training a shooters grip and trigger control. The device is designed to look and function just like a real hand gun including a barrel. However, due to its resemblance to a real handgun, it would not be safe to use this fear inducing device outside of training venues. Another disadvantage of this device is that it trains the user to use all fingers together by moving them at the same time. This slight movement of the other fingers adversely affects a shooters shot. Thus, this device does not isolate the trigger finger. In addition, handgun triggers are attached to the weapon by being pivoted from the top. This is conducive to trainees "jerking" the trigger instead of "squeezing" it. The present invention provides a trigger member which is mounted so that it can only move in a horizontal position with respect to the handle, thus providing the trainee with the correct trigger finger movement.

The present invention provides a method for aiding a trainee to develop smooth trigger control of a real handgun which includes providing the trainee with a handgun training device having only a single spring therein for aiding a trainee to develop smooth trigger control having:

a handle, sized and weighted to represent the actual weight and feel of a real handgun, but without a gun barrel, thus providing a non-threatening, non-fear inducing appearance of the handgun trigger trainer, allowing the handgun trigger trainer to be used anywhere without inducing fear in other people;

a trigger member, actuated by an index finger of the trainee, coupled to the handle via a single biasing spring (which, as discussed below may be changed) for biasing the trigger member in a forward direction and having a stiffness similar to the stiffness of an actual handgun trigger, for simulating triggering forces used in firing a real handgun;

instructing the trainee to smoothly actuate the trigger member over and over to produce smooth, even pressure to the trigger, thus enhancing accuracy of shots using real handguns.

The method preferably includes changing the stiffness of the biasing spring in accordance with different trigger stiffness of different handguns. The trainer can be constructed and/or arranged to be similar, as to size, feel and trigger pull, to a model of a real handgun, sans the barrel.

DESCRIPTION OF PREFERRED EMBODIMENTS OF THE INVENTION

Figure 1:
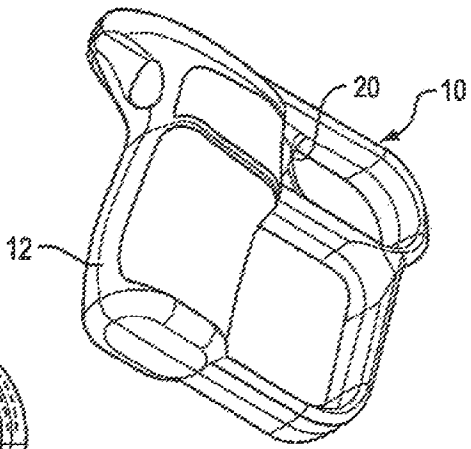
FIG. 1 is a perspective view of a preferred external appearance of the preferred handgun trainer of the present invention.

FIG. 1 shows the external appearance of the training device 10 of the invention having a handle 12 in a similar shape to a handle of an actual handgun, and a trigger assembly 18 (shown in FIGS. 2 and 3) having a curved shape component at its end which is the trigger 20 simulating an actual trigger of an actual handgun.

Figure 2:
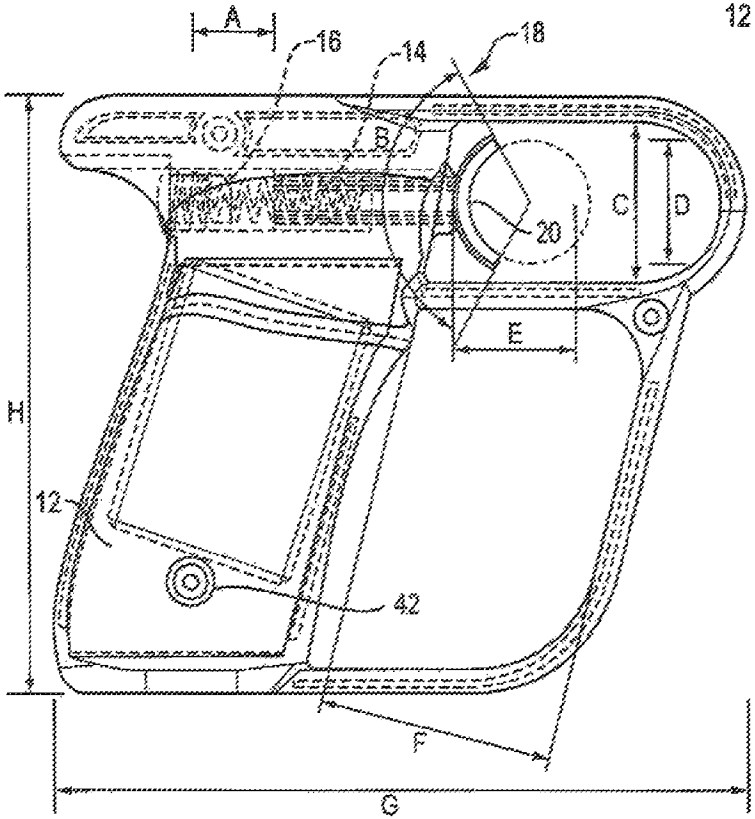
FIG. 2 is a cross sectional view of the handgun trainer which shows a spring biasing device internal of the handle of the trainer for controlling the stiffness or pull force resistance of the trigger.

FIG. 2 shows a single biasing spring 14 internal of the handle of the trainer for creating a trigger spring force associated with a particular type of handgun. Handle 12 is sized and weighted to represent the actual weight and feel of a real hand gun model, but without a gun barrel, thus providing a non-threatening, non-fear inducing appearance of the handgun training device, allowing the same to be used anywhere without inducing fear in other people.

Figure 3:
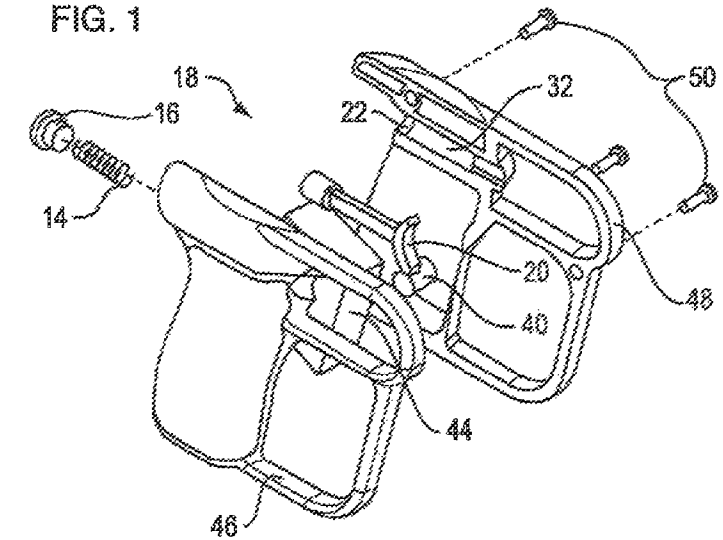
FIG. 3 is an exploded view of two portions of the handle of the training device.

FIG. 3 is an exploded view showing how the parts are arranged together. There is a cylindrical space 32 which contains the spring 14. A removable plug 16 is provided which has threads that fit into the grooves 22 formed in the cylindrical space. When the plug 16 is screwed into place, the trigger 20 is biased in a forward direction.

As shown in FIGS. 2 and 3, the trigger assembly 18, to be actuated by the index finger of a trainee, is positioned in the handle 12 via biasing spring 14 and a spring positioning member which includes removable plug 16 for biasing the trigger 20 in a forward direction, thus creating a stiffness similar to the stiffness of an actual handgun trigger, for simulating the triggering force of the handgun trigger of a particular real handgun being used by the trainee. The finger contact member, which is the trigger, 20 is actuated to the left as far as it will go during squeezing of the trigger to define the trigger stroke.

A set of at least two springs can be employed for substituting a second spring having a different stiffness than a first spring within the trainer to accommodate training in connection with a different firearm. a non-limiting example of such a device is shown in FIG. 2 in which the following are provided:

A is pre-compression of 0.323 in;

B is 120 degree finger contact;

C is 1.254 in;

D is 0.947 finger clearance;

E is 0.750 trigger stroke;

F is 1.854 grip clearance (approx.);

G is 5.432 in; and

H is 4.625 in.

Figure 7:
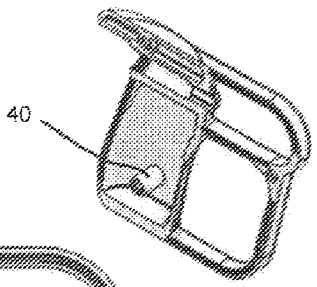
FIG. 7 is a perspective view of the grip part shown in FIG. 6.
Figure 6:
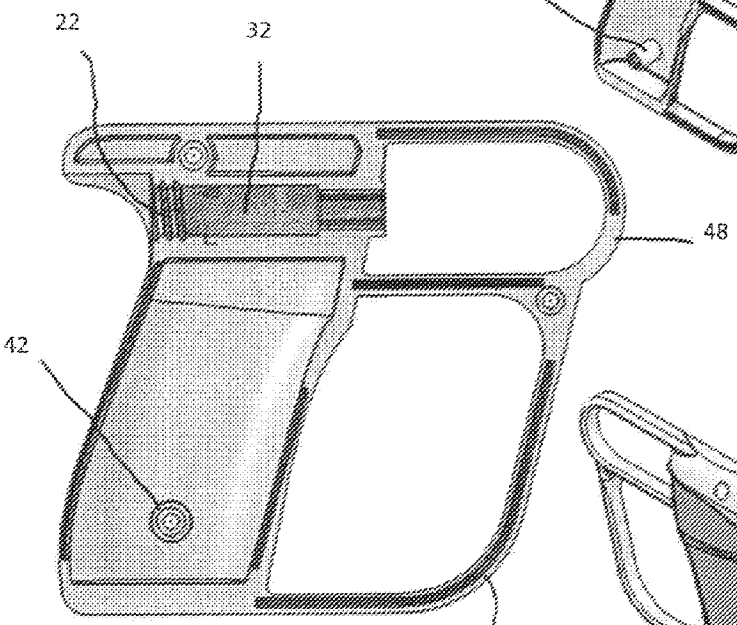
FIG. 6 is a side elevation view of the left part of the interior of the handle or grip showing the inside thereof.
Figure 5:
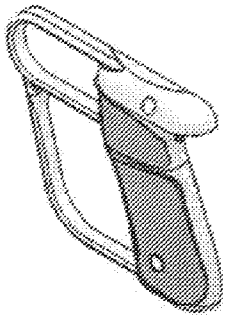
FIG. 5 is a perspective view of the grip part shown in FIG. 4.
Figure 4:
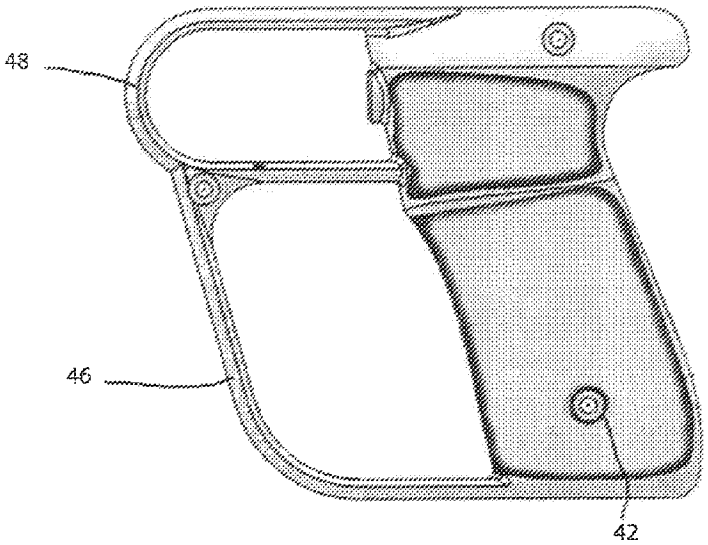
FIG. 4 is a side elevation view of the left part of the exterior of the handle or grip.

FIGS. 4 trough 7 show the training device from different positions. FIG. 4 is an elevation of the outside of the left handle part and FIG. 6 is an elevation of the inside of the left handle part. FIG. 4 shows the trigger guard 48 and the finger guard 46 as well as the screw in the handle for holding the right and the left handle parts together. FIG. 6 shows the cylindrical space 32 for the spring 14 as well as the grooves 22 into which the removable plug 16 is threaded. FIG. 5 is a perspective view of the exterior of the left part of the handle. FIG. 7 is a perspective view of the interior of the left part of the handle showing the open shaft 40 on the handle to accommodate the screw 42.

Figure 8:
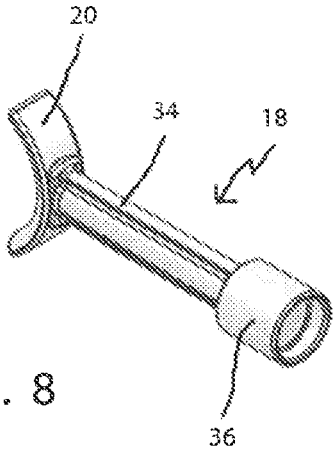
FIG. 8 is a perspective view of the trigger assembly.
Figure 9:
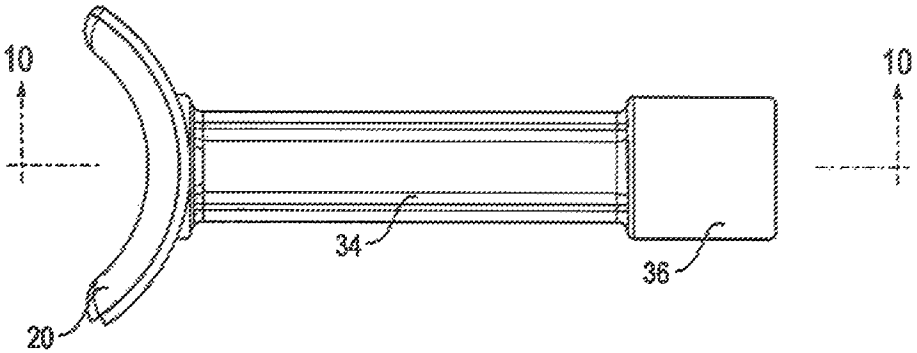
FIG. 9 is a side elevation of the trigger assembly shown in FIG. 8.
Figure 11:
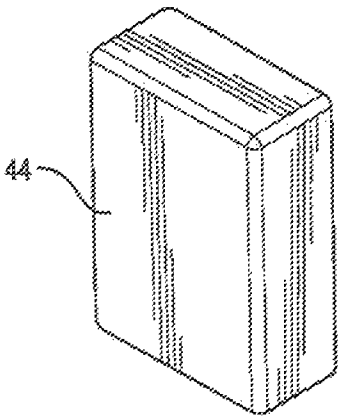
FIG. 11 is a perspective view of a training device counterbalance.
Figure 10:
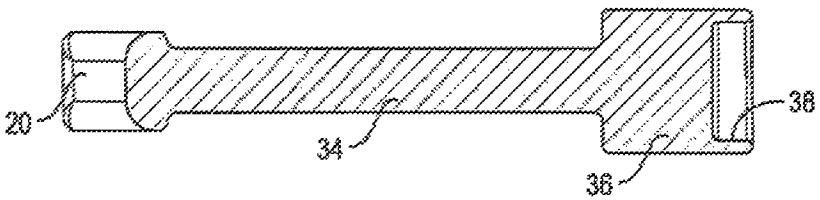
FIG. 10 is a cross sectional view taken along reference line A-A of FIG. 9.

The trigger assembly is shown in FIGS. 8, 9 and 10 and includes a cylindrical body 34 to which trigger 20 is attached at one end. On the other end is an enlarged portion 36 with a recess 38 into which the spring 14 fits to bias the trigger 20.

The spring positioning device in the form of a removable plug 16 is preferably a cylindrical space 32 for providing easy removal and replacement upon changing the springs producing differing trigger pull forces. Grooves 22 for accommodating the threads of plug 30 are shown in FIGS. 3 and 6.

The two parts of the handle 12 are held together by a screw 42 which fits through shaft 40 in the handle and there is a finger guard 48 as well as a handle guard 46. There is also a counterbalance 44 for compensating for the weight of the missing barrel so that the practice gun weight and balance will be similar to that of the real weapon being simulated.

Thus, the stiffness changing mechanism preferably includes two or more springs having different stiffness or spring constants, and the spring positioning device, takes the form of a removable plug 16 for coupling a selected spring 14 between the trigger member 18 and the forward portion of the cylindrical space 32 (which is reduced at the forward end) of the handle at any one time. A particular spring is selected for a particular firearm for providing the trainee with the correct pulling force for that particular firearm.

Figure 13:
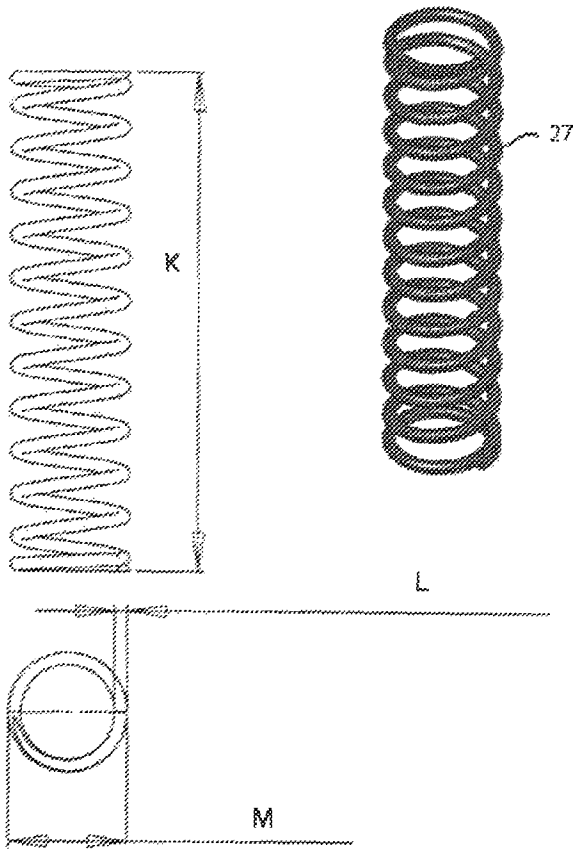
FIGS. 12 and 13 are perspective, side and end views of trigger biasing springs having a defined spring constant or stiffness related to the spring force of the handgun being simulated.
Figure 12:
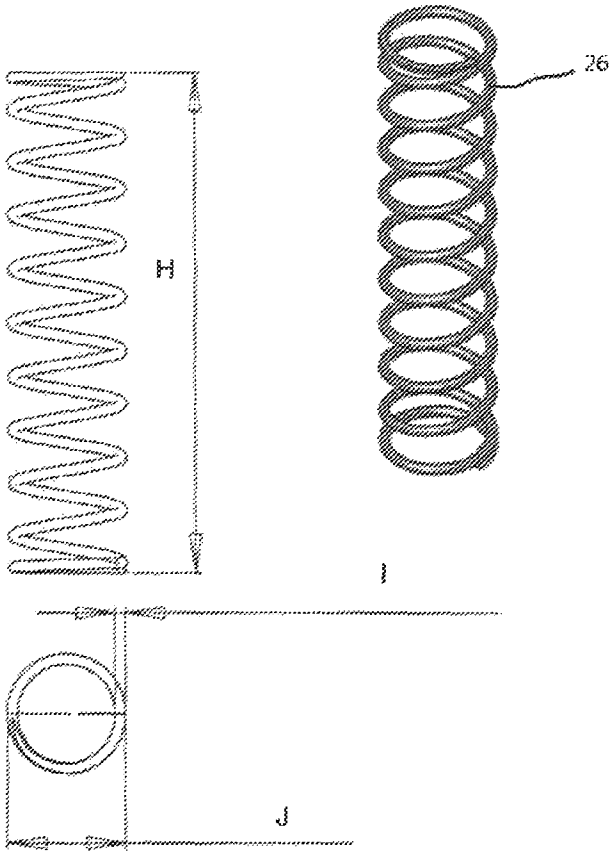

Two of such springs are shown in FIGS. 12 and 13.

In one, non-limiting, embodiment of the present invention, the first spring 26, shown in FIG. 12 has a wire diameter I of 0.032 inches that produces a trigger spring force of 3.8 pounds while the second spring 28, shown in FIG. 13 has a wire diameter L of 0.038 inches that produces a trigger spring force of 7.5 pounds. Both of these springs have a length (H and K) of 1.5 inches and a spring diameter J and M of 0.36 inches. The compressed length of spring 26 is 0.338 inches while the compressed length of spring 28 is 0.477 inches. Springs 26 and 28 may be color coded green and red, respectively, for ease of proper identification. A third spring (not shown) is contemplated and has a trigger spring force of 10 pounds. Also, additional springs with differing trigger spring force may be used.

The method of using the aforesaid training device is as follows:

(a) The operator will hold the training device 10 as one would hold a real hand gun, three fingers and the thumb will grip the handle 12 while the index finger applies pressure to the trigger mechanism 18. The operator will apply continuous pressure to the trigger 20 and then allow the spring to reset the trigger to its starting position. Continuous and repetitious operation of the training device will help the shooter build the required finger dexterity and muscle memory that is essential to marksmanship. This will aid in developing trigger control to the point where it becomes a subconscious skill.

(b) the trainee is provided with a handgun training device 10, for aiding the trainee to develop smooth trigger control of a real handgun, having (b-1) a handle 12, sized and weighted to represent the actual weight and feel of a real hand gun, but without a gun barrel, thus providing a non-threatening, non-fear inducing appearance of the handgun trigger trainer, allowing the handgun trigger trainer to be used anywhere without inducing fear in other people;

(b-2) a trigger 20, actuated by a finger of the trainee, coupled to the handle 12 via a biasing spring 14 for biasing the trigger in a forward direction and having a stiffness similar to the stiffness of an actual handgun trigger, for simulating triggering forces used in firing a real handgun; and (c) instructing the trainee to smoothly actuate the trigger member over and over to produce smooth, even pressure to the trigger, thus enhancing accuracy of shots using real handguns.

The method preferably includes inserting a particular biasing spring from a plurality of biasing springs having different stiffness within a training device associated with a particular firearm for providing the trainee with the correct trigger pulling force and motion for that particular firearm.

The method may include providing two or more biasing springs having different stiffness such as, for example, springs 26 and 28 and including replacing the first biasing spring 26 within the handle with the second biasing spring 28 in connection with training of a different handgun having a different trigger stiffness.

The method includes unscrewing the threaded plug 30 that maintains biasing of the first spring 26 against the trigger assembly 18, removing the first spring 26 from the handle 12 and inserting the second spring 28 within the handle 12 and screwing the threaded plug 30 against the second spring 28 for biasing the second spring against the trigger assembly 18.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as indicated by the language of the appended claims.

For example it may be feasible to employ the invention in connection with trigger actuated weapons other than handguns such as for example, rifles, carbines, or laser weapons.

While less preferred, the invention in its broadest aspect could involve changing the length of a biasing spring within the trainer with a threaded screw or the like in order to change its stiffness. However it is believed that this approach, in contrast with the aforesaid selection of particular springs, would tend to result in trigger force inaccuracy and confusion in changing the spring stiffness.

The invention claimed is:

1. A firearm training device for aiding a trainee to develop smooth trigger control of a real firearm comprising:

a handle, sized and weighted to represent the actual weight and feel of a real firearm, without a gun barrel;

a space within an upper portion of said handle, said space being of two predetermined interiors, a front section of one predetermined interior and a rear section of the other predetermined interior larger than said predetermined interior of said front section; and a trigger assembly attached to said handle, said trigger assembly having a body, an enlarged portion with a recess for accepting one end of at least one biasing device at one end of said body and a trigger fixed to or formed integrally with part of another end of said body, the enlarged portion located within the larger predetermined space; said trigger arranged to be actuated by a finger of a trainee and mounted to only move in a horizontal position with respect to the handle;

wherein said at least one biasing device is configured for biasing said trigger in a forward direction away from the handle, said at least one biasing device having a stiffness similar to the stiffness of an actual firearm trigger, for simulating triggering forces used in firing a real firearm.

2. The trigger trainer of claim 1 wherein the at least one biasing device is a spring.

3. The trigger trainer of claim 2 wherein a stiffness changing mechanism is provided and includes two or more springs having different stiffness, and a spring positioning device for coupling one of the springs between the trigger and a portion of said handle.

4. The trigger trainer of claim 3 wherein said spring positioning device has a removable plug for enabling substitution of a second spring for a first spring.

5. The trigger trainer of claim 4 wherein said removable plug is a threaded cylindrical member for providing easy removal and replacement of said removable plug.

6. The trigger trainer of claim 4, wherein said trigger has a curved component resembling the shape of actual triggers of real firearms.

7. The trigger trainer of claim 3, wherein said trigger has a curved component resembling the shape of actual triggers of real firearms.

8. The trigger trainer of claim 1 wherein said trigger has a curved component resembling the shape of actual triggers of real firearms.

9. The trigger trainer of claim 1 wherein said firearm is a handgun without a barrel.

10. A firearm trigger trainer for aiding a trainee to develop smooth trigger control of a real firearm comprising:

a handle, sized and weighted to represent the actual weight and feel of a real firearm, without a gun barrel;

a space within an upper portion of said handle, said cylindrical space being of two predetermined interiors, a front section of one predetermined interior and a rear section of the other predetermined interior larger than said predetermined interior of said front section; and a trigger assembly attached to said handle, said trigger assembly having a body, an enlarged portion with a recess for accepting one end of at least one spring device at one end and a trigger fixed to or formed integrally with another end of said body, the enlarged portion located within the larger predetermined space;

wherein said trigger, actuated by a finger of a trainee, is coupled to said handle via said at least one spring device having only a single spring for biasing said trigger member in a forward direction and having a stiffness similar to the stiffness of an actual firearm trigger, for simulating triggering forces used in firing a real firearm.

11. The trigger trainer of claim 10 wherein a stiffness changing mechanism is provided.

12. The trigger trainer of claim 11 wherein said stiffness changing mechanism includes two or more springs having different stiffness, and a spring positioning device for coupling one of the springs between the trigger member and a portion of said handle at any one time.

13. The trigger trainer of claim 12 wherein said spring positioning device has a removable plug for enabling substitution of a second spring for a first spring.

14. The trigger trainer of claim 13 wherein said removable plug is a threaded cylindrical member for providing easy removal and replacement of said removable plug.

15. The trigger trainer of claim 12 wherein said trigger member has a curved component resembling the shape of actual triggers of real firearms and is mounted to only move in a horizontal position with respect to the handle.

16. The trigger trainer of claim 10 wherein said trigger member has a curved component resembling the shape of actual triggers of real firearms.

* * * * *